US005392680A

United States Patent [19]

Stets

[11] Patent Number: 5,392,680

[45] Date of Patent: Feb. 28, 1995

[54] TREMOLO DEVICE FOR STRINGED MUSICAL INSTRUMENT

[76] Inventor: Eric P. Stets, 50 East & West Rd., West Seneca, N.Y. 14224

[21] Appl. No.: 206,527

[22] Filed: Mar. 4, 1994

[51] Int. Cl.[6] ..... G10D 3/00

[52] U.S. Cl. ..... 84/313

[58] Field of Search ..... 84/298, 307, 313

[56] References Cited

U.S. PATENT DOCUMENTS

| | | | |
|---|---|---|---|
| 3,248,991 | 5/1966 | Cole | 84/313 |
| 3,466,962 | 9/1969 | Cole | 84/312 |
| 4,610,190 | 9/1986 | Maloney | 84/312 R |
| 4,656,915 | 4/1987 | Osoga | 84/313 |
| 4,688,461 | 8/1987 | Stroh | 84/298 |
| 4,704,936 | 11/1987 | Steinberger | 84/313 |
| 4,984,493 | 1/1991 | Schaller | 84/313 |

*Primary Examiner*—M. L. Gellner
*Assistant Examiner*—Patrick J. Stanzione
*Attorney, Agent, or Firm*—James F. Mudd

[57] ABSTRACT

An improved tremolo device for a stringed musical instrument provides a fixed plate attached to the body portion, a fixed gear rack with teeth, and a movable plate that is slideable with respect to the fixed plate and has a bridge member. A pinion gear having teeth around the circumference thereof is provided to mesh with the teeth of the fixed gear rack and to move in unison with the movable plate. A lever is attached to the pinion gear for rotating the pinion gear to change the tension on the strings. The fixed plate has a slot or groove in the face thereof opposite the body, and the movable plate has a slot or groove in the face thereof opposite the fixed plate to form one or more cavities in which anti-friction bearings are encased. In the operation of the tremolo device of the invention, tension in the strings is decreased by depressing the lever which causes pinion gear to rotate, thereby driving the movable plate to cause the tremolo effect when the musical instrument is played. Tension on strings is increased by releasing the lever, and the sound of the instrument returns to is original pitch.

15 Claims, 2 Drawing Sheets

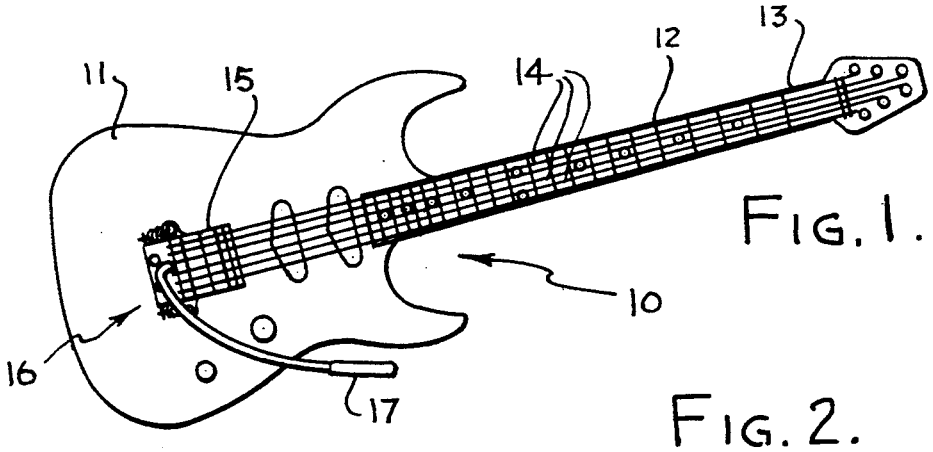
FIG. 1.
FIG. 2.
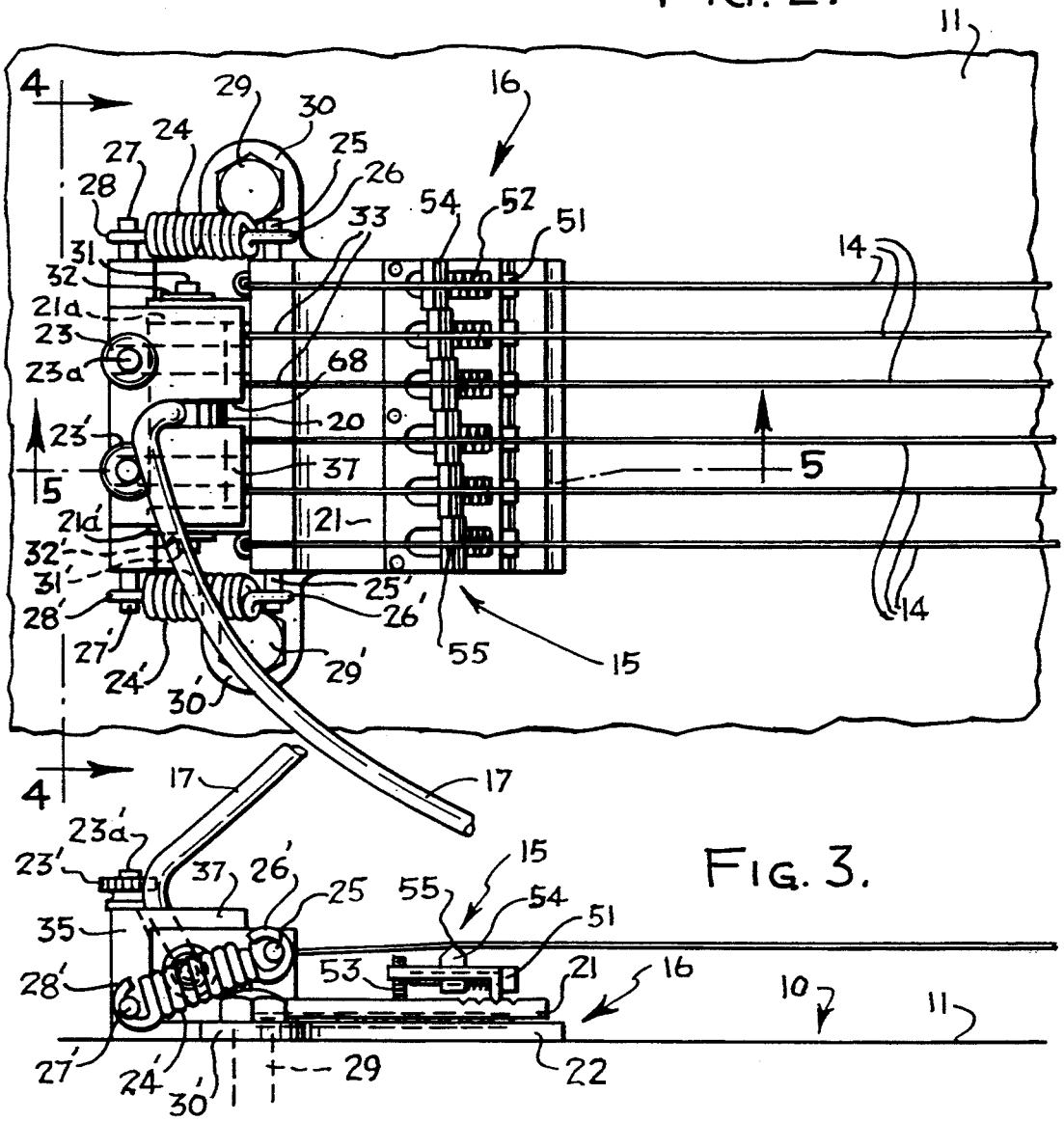
FIG. 3.

TREMOLO DEVICE FOR STRINGED MUSICAL INSTRUMENT

BACKGROUND OF THE INVENTION

1. Field of the Invention

The invention relates to an improved tremolo device for use with a stringed instrument such as a guitar. The invention also relates to a stringed instrument having an improved tremolo device.

It is often desired to provide stringed instruments with a tremolo device that allows the instrument to produce its normal tones, but also to produce a tremulous tone effect, by suitable operation of the tremolo device. Existing stringed instruments can also be modified with the tremolo device of the invention. The tremulous tone effects result from changing the tension on the strings of the instrument. While these effects can be produced with other stringed musical instruments such as violins, base guitars, cellos and banjos, the description will be directed to guitars, which include acoustical and electric guitars.

In a conventional guitar, comprised of a body portion, a neck portion and a head portion, the strings attached at the head portion of the instrument, pass over the neck portion of the instrument and then pass over a bridge located in the body portion, and are then attached to the body of the guitar with a tailpiece. When certain tremolo devices known in the prior art are employed, sufficient friction can develop in the mechanisms of their tremolo devices that the tremolo devices may not always return to their original position, thereby resulting in poor sound quality emanating from the guitar.

2. Prior Art

U.S. Pat. No. 4,688,461 to Stroh discloses a conventional tremolo device especially in FIG. 7, which provides for a complex mechanism involving upright block 34 and bore 35 for placement of the string 4. Installation of the Stroh device requires a massive cut into the body portion of the instrument.

The Stroh invention does not involve the tremolo device itself, but rather appears to center around changes in the bridge assembly, especially with respect to the saddle devices that engage the strings of the guitar. The Stroh improvements appear to relate to gear operated mechanisms in the saddle structure. Stroh discloses that these mechanisms are associated with saddle devices such as 37' in FIGS. 14, 17, and 18.

U.S. Pat. No. 4,984,493 to Schaller discloses a tremolo device similar to that of Stroh, but the disclosed invention appears to reside in device 60 of Schaller.

Other patents related to tremolo devices are described below.

U.S. Pat. No. 3,466,962 (Cole) discloses a tremolo device having a handle or lever that can be operated by a guitar player so that it can be raised or lowered in a vertical plane as well as rotated in a horizontal plane, thereby causing a cradle member which carries a plurality of strings to be actuated so as to produce a lower pitch tone or raised pitch tone, thereby permitting playing in a different key.

U.S. Pat. No. 4,610,190 (Maloney) discloses a pitch raising system for a guitar providing a mechanical means to produce musical techniques usually performed manually. The preferred mode includes a pitch raising device and other elements.

U.S. Pat. No. 4,656,915 (Osaga) discloses a mechanism that is provided with a device against which the strings are pressed, and which is rotatable around a rotary shaft located between the bridge and the string-fixing part of the guitar.

U.S. Pat. No. 4,704,936 (Steinberger) discloses a tremolo tailpiece which pivots around a pivot point and anchors one end of each string while varying the absolute pitch of the strings and maintaining the relative pitch of the strings during pivoting.

SUMMARY OF THE INVENTION

The purpose of the invention is to provide an improved tremolo device that can be readily attached to a conventional guitar or other stringed instrument, and which does not require cutting away any part of the body of the guitar that might be expected to adversely affect the quality of the instrument.

The invention involves a tremolo device comprising a rack and pinion gear mechanism that is mounted on the surface of a guitar body such that it is not necessary to remove any portion of the guitar body to attach the tremolo device. In fact the tremolo device of the invention can be attached to the guitar body with the same screws that held the original tailpiece on the guitar body.

The invention further comprises a stringed musical instrument comprising a head portion, a neck portion, a body portion, a plurality of generally parallel strings attached to said head portion and said body portion, and a bridge member which engages the strings in a position adjacent to the body portion, and having an improvement comprising a fixed plate attached to said body portion, a fixed gear rack means with teeth attached to the fixed plate on the side opposite said body portion, and a movable plate that slides on the fixed plate. The movable plate has a bridge member attached on the side opposite the fixed plate member. The pinion gear member has teeth around the circumference thereof, wherein the teeth of the pinion gear member mesh with the teeth of the gear rack member. The pinion gear member and the bridge member are attached to and movable in unison with the movable plate. A lever means is attached to the pinion gear for rotating the pinion gear to change the tension on the strings. The gear rack and fixed plate and movable plate are held in relative position with respect to each other by the tension applied to the strings and the counter tension applied by one or more metal springs attached at one end of the metal spring to the fixed plate and at the other end of the metal spring to the movable plate.

The invention further involves means for attaching the strings to the movable plate wherein the strings pass through string mounting holes located in the movable plate, wherein the strings terminate in terminal ends, such as ring members.

The invention further involves slots or grooves in the face of the fixed plate member and slots or grooves in the face of said movable plate. The opposing slots or grooves form cavities wherein anti-friction bearings, such as needle bearings, are encased by the slots or grooves.

In the operation of the tremolo device of the invention, tension in the strings is decreased by depressing the lever which causes the pinion gear to rotate, thereby driving the movable plate to cause the tremolo effect when the musical instrument is played. Tension on the strings is increased by releasing the lever, and the sound of the instrument returns to is original pitch.

BRIEF DESCRIPTION OF THE DRAWING

FIG. 1 is an elevational view of a musical instrument on which the invention may be used.

FIG. 2 is an enlarged fragmentary portion of the body portion of the instrument in the left end of FIG. 1.

FIG. 3 is a side elevation of FIG. 2.

DETAILED DESCRIPTION OF DRAWING

Figures 4, 5, 6, 7, 8:
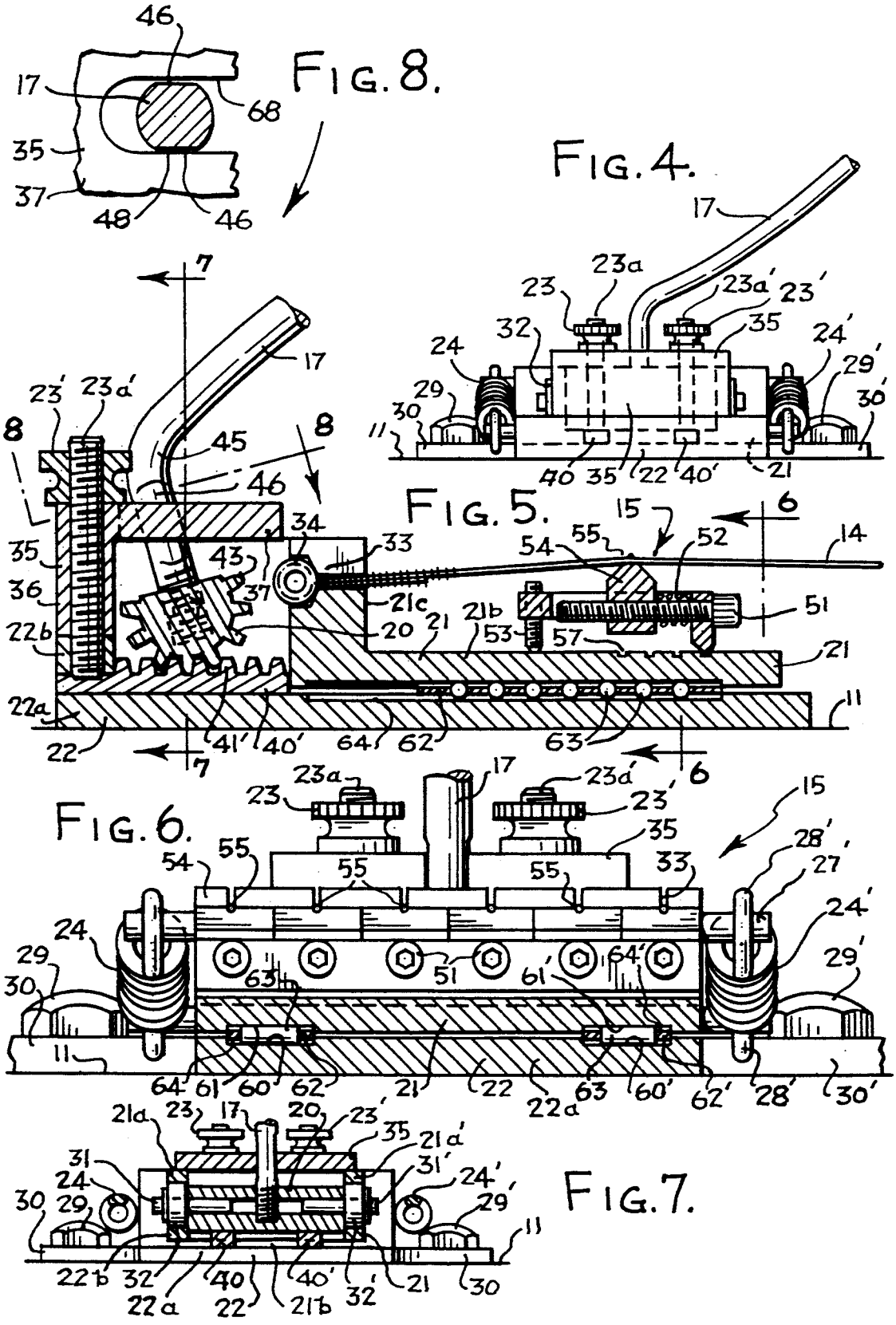
FIG. 4 is an end elevation of FIG. 3 generally along line 4—4 in FIG. 2.
FIG. 5 is an enlarged vertical section taken along line 5—5 in FIG. 2.
FIG. 6 is a vertical section taken along line 6—6 of FIG. 5.
FIG. 7 is a reduced vertical section taken along 7—7 in FIG. 5.
FIG. 8 is a greatly enlarged fragmentary section taken along line 8—8 of FIG. 5.

FIG. 1 shows a conventional musical instrument such as a guitar 10, which comprises a body portion 11, a head portion 12, a neck portion 13, a multiplicity of strings 14 and a bridge member 15. A tremolo device 16 of the invention is shown attached to the body portion 11 of the guitar 10. Lever 17 of the invention is shown as part of tremolo device 16.

A fragmentary portion of the body portion 11 of guitar 10 is shown in FIG. 2. The tremolo device 16 of the invention is shown attached to body portion 11 by means of metal bolts 29 and 29' that pass through metal lugs 30 and 30' and into body portion 11. Pinion gear 20 is joined to bracket 21*a* of movable plate 21 by means of metal spindles 31 and 31' that are attached to movable plate 21 and seated in bearings 32 and 32'. In addition to bracket 21*a*, movable plate 21 has a horizontal portion or component 21*b* and a vertical portion or component 21*c*. Lever 17 is shown attached to pinion gear 20. Metal thumb nuts 23 and 23' together with metal screws 23*a* and 23*a*', respectively, serve to attach metal lock cover 35 to fixed plate 22. Metal spring 24 is attached to movable plate 21 and fixed plate 22 by means of hooks 26 and 28, respectively, that are attached to perches 25 and 27, respectively. The metal spring 24' is attached to movable metal plate 21 and fixed metal plate 22 by means of hooks 26' and 28' respectively, that are attached to perches 25' and 27', respectively. The metal springs 24 and 24' serve to apply tension to counter the tension being exerted by strings 14, to hold movable plate 21 and fixed plate 22 in relative position with respect to each other.

FIG. 2 further shows six strings 14 positioned in essentially parallel direction. The strings extend from the head portion 12 of the guitar 20 as shown in FIG. 1. The strings pass over the saddle notches 55 of the saddle members 54 of bridge member 15. The strings 14 pass through string mounting holes 33 in the vertical portion 21*c* of movable block 21 and terminate in a suitable terminal end such as terminal rings 34.

FIG. 3 is a side elevation of FIG. 2 which shows a cutaway view of the body portion 11 of guitar 10. Fixed plate 22 is attached to body portion 11 by means of bolt 29' which passes through metal lug 30' into body portion 11. Relative positions of fixed plate 22 and movable plate 21 are maintained by the tension applied by strings 14 and the counter tension applied by metal spring 24'. Metal spring 24' is attached to movable plate 21 and fixed plate 22 by means of hooks 26' and 28', respectively, that are attached to perches 25' and 27', respectively. String 14 passes over saddle notches 55 of saddle members 54 of bridge 15 and toward movable plate 21. Lever 17 is attached to pinion gear 20. Metal lock cover 35 is attached to fixed plate 22 by metal thumb nut 23 and metal screw 23*a* as shown in FIG. 5.

FIG. 4 is an end elevation of FIG. 3 generally along line 4—4 in FIG. 2. Fixed plate 22 is attached to body portion 11 by means of metal bolts 29 and 29' which pass through metal lugs 30 and 30', respectively, and into body portion 11. Pinion gear 20 is joined to bracket 21*a* of movable plate 21 by means of metal spindles 31 and 31' that are seated in bearings 32 and 32', respectively. Metal spring 24 is attached to movable plate 21 and fixed plate 22 by means of hooks 26 and 28, respectively, that are attached to metal perches 25 and 27, respectively, as shown in FIG. 2. Metal spring 24' is attached to movable plate 21 and fixed plate 22 by means of hooks 26' and 28', respectively, that are attached to perches 25' and 27', respectively, as shown in FIG. 2. Metal thumb nuts 23 and 23' pass through horizontal portion 37 and vertical portion 36 of metal lock cover 35 and attach the metal lock cover 35 to fixed plate 22 as shown in FIG. 5. Fixed plate 22 can comprise horizontal component 22*a* and vertical component 22*b* which can be made in one piece or can be individually produced and fastened together. Gear racks 40 and 40' protrude from fixed plate 22 as shown in FIG. 5. Lever 17 is attached to pinion gear 20.

In FIG. 5, fixed plate 22 is attached to the body portion 11 of the guitar 10. A gear rack 40 is attached to the upper surface of the horizontal component 22*a* of fixed plate 22. A pinion gear 20 is linked to movable plate 21 by means of metal spindles 31 and 31' at the ends of pinion gear 20, which are fastened in bearings 32 and 32', which are mounted in brackets 21*a* on the movable plate 21 as shown in FIG. 2. A lever 17 is attached to the pinion gear 20. Strings 14 pass over the saddle notches 55 of bridge 15, then through string mounting holes 33 in movable plate 21, terminating in a terminal end such as a ring 34. All the components of movable plate 21, that is bracket 21*a*, horizontal component 21*b* and vertical component 21*c* can be cast in one piece or can be individually produced and fastened together.

FIG. 5 further shows the details of the gear rack 40 which is provided with teeth 41. Pinion gear 20 is provided with teeth 43 around the circumference thereof. Lever 17 is preferably provided with a bend 45, and optionally with flat surfaces 46 which can be machined into the surfaces of the lever 17 near where it adjoins with the pinion gear 20. When desired, the lever 17 can be twisted or rotated so that the machined surfaces 46 of the lever 17 can be tightened up in the confines of the slot 48 in the upper portion of the horizontal portion 37 of the metal cover 35, as shown in FIG. 8.

Each string 14 is provided with a bridge member 15. In FIG. 5, the bridge 15 is provided with saddle notch 55 of saddle 54. String 14 rests in the saddle notch 55. The saddle adjustment screws 51 adjust the saddle 54 longitudinally to lengthen or shorten the pitch length of the string 14. Saddle tension spring 52 prevents the saddle 54 from floating or moving on its own. The saddle tension spring 52 provides sufficient tension to retain the adjusted position. The bridge height adjustment screw 53 adjusts the height of the bridge 15. The bridge reference point 56 is situated in the bridge reference groove 57 and is used when needed to find another point of adjustment beyond that normally provided.

Furthermore in FIG. 5, anti-friction bearings such as needle bearings 63 are contained in the cavity created by slots 60 and 61 that have been cut in the opposing faces of fixed plate 22 and movable plate 21, respectively. Bearing cage 62 maintains the bearings 63 in relative position.

In the operation of the tremolo device of the invention, tension in string 14 is decreased by depressing lever 17 which causes pinion gear 20 to rotate, thereby driving the movable plate 21 to cause the tremolo effect when the musical instrument 10 is played. Tension on string 14 is increased by releasing lever 17, and the sound of the instrument returns to is original tone.

FIG. 6 is a vertical section taken along line 6—6 of FIG. 5. Fixed plate 22 is shown attached to body portion 11 by means of metal bolts 29 and 29' which pass through lugs 30 and 31', respectively, into body portion 11. The tension applied by strings 14 and the opposing or counter tension applied by metal springs 24 and 24' serve to maintain the relative position of fixed plate 22 and movable plate 21. Perches 27 and 27' protrude from movable plate 21. Hooks 28 and 28' engage the perches 27 and 27', respectively, as shown in greater detail in FIGS. 2 and 3. Metal thumb nuts 23 and 23' attach metal lock cover 35 as shown in FIG. 3 and FIG. 5. String mounting holes 33 permit the passage of strings 14 into and through the movable plate 21. Slots 60 and 60' are machined in the upper face of fixed plate 22. Slots 61 and 61' are machined in the lower face of movable plate 21. These slots form cavities 64 and 64' for insertion of anti friction bearings, such as needle bearings 63 and 63'. Bearing cages 62 and 62' made of plastic material maintain the bearings 63 and 63' in their proper relative positions within cavities 64 and 64'.

FIG. 7 is a reduced vertical section taken along line 7—7 in FIG. 5. Fixed plate 22 is attached to body portion 11 by metal bolts 29 and 29' which pass through metal lugs 30 and 30', respectively into body portion 11, as shown in FIG. 6. The horizontal component **22*a* and the vertical component 22*b* are show in FIG. 7. Fixed gear racks 40 and 40' are attached to the horizontal component 22*a* of fixed plate 22. Pinion gear 20 is attached to movable plate 21 at brackets 21*a* and 21*a'* by means of metal spindles 31 and 31' seated in bearings 32 and 32', respectively. Metal thumb nuts 23 and 23' are used to attach metal lock cover 35 to the fixed plate 22 with the aid of metal screws 23*a* as shown in FIG. 5. Metal springs 24 and 24' are used to hold movable plate 21 in relative position to fixed plate 22 by virtue of the tension applied by strings 14 which balances the counter tension applied by the metal springs 24 and 24'. Lever 17 is attached to pinion gear 20**.

FIG. 8 is a greatly enlarged fragmentary section taken along line 8—8 of FIG. 5. Horizontal portion 37 of metal lock cover 35 has a slot 68 into which is inserted lever 17 at its machined surface 48. The structure allows for lever 17 to lock when rotated in fixed a position when the tremolo effect is not desired. When a tremolo effect is desired lever 17 is rotated out from the locked position.

The tremolo device of the invention is suitable for use in various stringed instruments, such as acoustic and electric guitars, base guitars, violins, cellos an banjos. The strings for such instruments are generally six in number, but there can be as many as 12 strings. Base guitars generally have 4, 5, or 6 strings. The strings for such instruments can be made of nickel alloys, stainless steels, brass and plastics such as nylon. The body of stringed instruments is generally made of wood. Some stringed instruments have some metal parts.

The tremolo device of the invention can be made of various metals. The fixed and movable plates are generally made of low carbon steel or bronze. The gear rack and pinion gear are generally made of brass or low carbon steel.

The bearings are preferably needle bearings, but other bearings, such as roller or ball bearings can be employed.

The bearing cage materials can be made of plastics, such as nylon or polyoxymethylenes (Delrin).

I claim:

1. In a stringed musical instrument comprising a head portion, a neck portion, a body portion, a plurality of generally parallel strings attached to said head portion and to said body portion, and a bridge member which engages said strings in a position adjacent to said body portion, the improvement comprising a fixed plate means attached to said body portion, a fixed gear rack means with teeth, said fixed gear rack means being attached to said fixed plate means, a movable plate means that is slideable with respect to said fixed plate means, wherein said movable plate means has a pinion gear means having teeth around the circumference thereof, said pinion gear means and said bridge member being attached to and movable in unison with said movable plate means, and lever means attached to said pinion gear means for rotating said pinion gear means so as to change the tension on said strings.

2. The musical instrument of claim 1 which comprises at least one metal spring that is attached at one end to said fixed plate means and at the other end to said movable plate means.

3. The musical instrument of claim 2 wherein said strings are attached to said movable plate means, wherein said strings pass through said movable plate means and wherein said strings terminate in terminal ends.

4. The musical instrument of claim 3 wherein said fixed plate means has a slot or groove in the face thereof opposite said body portion, said movable plate means has a slot or groove in the face thereof adjoining said fixed plate means, wherein the opposing slots or grooves form a cavity wherein anti-friction bearings are encased.

5. The musical instrument of claim 4 which comprises a lock cover positioned above said fixed gear rack means and said pinion gear, a slot opening in said lock cover for receiving said lever and locking said lever in a fixed position, with respect to said lock cover.

6. In a stringed musical instrument comprising a head portion, a neck portion, a body portion, a plurality of generally parallel strings attached to said head portion and to said body portion, and a bridge member which engages said strings in a position adjacent to said body portion, the improvement comprising a fixed plate means attached to said body portion, a fixed gear rack means with teeth, said fixed gear rack means being attached to said fixed plate means on the side opposite said body portion, a movable plate means that is slideable with respect to said fixed plate means, wherein said movable plate means has said bridge member attached to said movable plate means on the side of the movable plate means opposite the fixed plate means, a pinion gear means having teeth around the circumference thereof, wherein the teeth of said pinion gear members mesh with the teeth of said fixed gear rack means, said pinion gear means being attached to and movable in unison with said movable plate means, and lever means attached to said pinion gear means for rotating said pinion gear means to change the tension on said strings.

7. The musical instrument of claim 6 which comprises two metal springs that are attached at one end to said fixed plate means and at the other end to said movable plate means, wherein the tension applied by said strings and the counter tension applied by said metal spring hold said fixed gear rack means and said movable plate in relative position with respect to each other.

8. The musical instrument of claim 7 wherein said strings are attached to said movable plate means, wherein said strings pass through said movable plate means and wherein said strings terminate in terminal ends.

9. The musical instrument of claim 7 wherein said fixed plate means has a slot or groove in the face thereof opposite said body portion, said movable plate means has a slot or groove in the face thereof adjoining said fixed plate means, wherein the opposing slots or grooves form a cavity wherein anti-friction bearings are encased.

10. The musical instrument of claim 9 which comprises a lock cover positioned above said fixed gear rack means and said pinion gear, a slot opening in said lock cover for receiving said lever and locking said lever in a fixed position, with respect to said lock cover.

11. A tremolo device for use in a stringed musical instrument comprising a fixed plate means adapted to be attached to the body portion of a stringed musical instrument, a fixed gear rack means with teeth, said fixed gear rack means being attached to said fixed plate means on the side opposite said body portion, a movable plate means that is slideable with respect to said fixed plate means, wherein said movable plate means has said bridge member attached to said movable plate means on the side of the movable plate means opposite the fixed plate means, a pinion gear means having teeth around the circumference thereof, wherein the teeth of said pinion gear means mesh with the teeth of said fixed gear rack means, said pinion gear means being attached to and movable in unison with said movable plate means, and lever means attached to said pinion gear means for rotating said pinion gear means so as to change the tension on said strings.

12. The tremolo device of claim 11 which comprises a metal spring that is attached at one end to said fixed plate means and at the other end to said movable plate means wherein the tension applied by said strings and the counter tension applied by said metal spring hold said fixed gear rack means and said movable plate in relative position with respect to each other.

13. The tremolo device of claim 12 wherein said strings are attached to said movable plate means, wherein said strings pass through said movable plate means, wherein said strings terminate in terminal ends.

14. The tremolo device of claim 13 wherein said fixed plate means has a slot or groove in the face thereof opposite said body portion, said movable plate means has a slot or groove in the face thereof adjoining said fixed plate means, wherein the opposing slots or grooves form a cavity wherein anti-friction bearings are encased.

15. The tremolo device of claim 14 which comprises a lock cover positioned above said fixed gear rack means and said pinion gear, a slot opening in said lock cover for receiving said lever and locking said lever in a fixed position with respect to said lock cover.

* * * * *